US005433834A

United States Patent [19]

Belz et al.

[11] Patent Number: 5,433,834

[45] Date of Patent: Jul. 18, 1995

[54] APPARATUS FOR ELECTROLYTICALLY COATING SMALL PARTS

[75] Inventors: Hans Belz, Herdecke; Burkard Flamme, Hagen; Werner Schauf; Hans Günter Engels, both of Solingen, all of Germany

[73] Assignee: Ewald Dorken AG, Herdecke, Germany

[21] Appl. No.: 211,469

[22] PCT Filed: Feb. 10, 1993

[86] PCT No.: PCT/DE93/00122

§ 371 Date: Mar. 3, 1994

§ 102(e) Date: Mar. 3, 1994

[87] PCT Pub. No.: WO93/17155

PCT Pub. Date: Sep. 2, 1993

[30] Foreign Application Priority Data

Feb. 25, 1992 [DE] Germany ..... 42 05 672.1

[51] Int. Cl.[6] ..... C25D 7/00; C25D 17/20; C25D 17/28

[52] U.S. Cl. ..... 204/213; 204/300 EC; 204/299 EC; 204/275

[58] Field of Search ..... 204/299 EC, 300 EC, 204/213, 275

[56] References Cited

U.S. PATENT DOCUMENTS 4,210,497 7/1980 Loqvist et al. ..... 205/50
4,227,986 10/1980 Loqvist et al. ..... 204/209 X
5,164,056 11/1992 Loeck ..... 204/300 EC

*Primary Examiner*—Donald R. Valentine
*Attorney, Agent, or Firm*—Herbert Dubno

[57] ABSTRACT

An apparatus for electrolytically coating small parts, e.g. by electrophoretic deposition from a liquid coating agent, has a screw-type conveyor which can have a tube open at opposite ends to form an inlet and outlet for the parts which are advanced through the tube by screw conveyor means like a helical ribbon. The inlet side of the tube is immersed in a basin of the liquid coating agent whose side walls and front wall form weirs determining the level of the liquid coating agent in the tube while the liquid passes from the tube into a catch basin beyond the rear wall through perforations in the tube. The contacts traversing the tube wall are electrically-conductively coupled to the parts and are tied to one terminal of the DC power source whose other terminal is connected to a plate immersed in the dipping basin.

10 Claims, 2 Drawing Sheets

APPARATUS FOR ELECTROLYTICALLY COATING SMALL PARTS

CROSS REFERENCE TO RELATED APPLICATIONS

This application is a national phase of PCT/DE93/00122 filed 10 Feb. 1993 and based in turn on German national application P42 05672.1 filed 25 Feb. 1992 under the International Convention.

FIELD OF THE INVENTION

The present invention relates to an apparatus for electrolytically coating small parts that are electrically conductive, in particular metal parts. More particularly the invention relates to an apparatus comprising a bath of electrically conductive liquid coating agent connected to one pole of a DC power source (the cathode or the anode), whereas the material that is to be coated is electrically connected to the other pole (anode or cathode) of the DC power source.

BACKGROUND OF THE INVENTION

Electrophoretic enamelling is performed with known apparatuses in which a coating agent is deposited cathodically or anodically on small metal parts. This apparatus can consist of a closed drum in which the small metal parts are placed.

In addition, the coating agent is also placed in the drum; the inside of the drum is made so as to be electrically conductive and is connected to one pole of a power source, whereas the coating agent is connected to the other pole of the power source.

During operation of the drum, the small metal parts assume the same potential as the drum, so that the coating agent with the opposite potential is deposited on the small parts. The process for coating such small parts is extremely costly because the drum must first be filled with the small parts, and then the coated or electrophoretically enamelled small parts have to be removed from the drum once again. Using the prior art, only a discontinuous mode of operation is possible, so that the production rate per unit time of small parts is confined to narrow limits.

OBJECT OF THE INVENTION

It is the object of the present invention to provide an apparatus which, for a small outlay, permits a high throughput rate of small metal parts for purposes of electrophoretic enamelling.

SUMMARY OF THE INVENTION

This object is achieved in accordance with the invention in that the apparatus comprises a screw conveyor that has electrically conductive contacts inside its conveyor tube, these contacts being connected to one pole of the DC power source; and in that part of the cross section of the screw conveyor is located in a dipping bath that is connected to the other pole.

Because of this configuration, it is possible to plate small metal parts in a continuous throughput process using electrophoretic enamelling while achieving a high throughput of material for low personnel outlay.

The small parts can be fed to the screw conveyor using a conventional conveyor system. In the same way, the coated small parts can be removed by using a conveyor system that follows the screw conveyor.

The screw conveyor can be configured as a ribbon-type screw conveyor.

Such screw conveyors are known in the prior art; in these, a ribbon-type screw conveyor in the form of a helical ribbon is rotatably supported within a stationary tube, and this ribbon effects the throughput of the small parts.

It is a disadvantage that in such a screw conveyor there are interior supports and that the objects that are being moved can become jammed or cause stoppages because of the movement of the ribbon-type conveyor relative to the tube that surrounds it.

For this reason, it is preferred that the screw conveyor have a rotating conveyor tube forming the supporting element for the small parts and a ribbon-type conveyor be secured to the inside periphery as the thrust organ, with the open ends of the conveyor tube forming the small-part feed and the small-part removal openings.

Such screw conveyors are also known in the prior art. The advantage of these screw conveyors is that there are no interior supports and, because of the fixed arrangement of the ribbon conveyor on the rotating tube, there can be no jamming or blockages.

It is also an advantage that the material can be introduced and removed at the ends of the tube. Here, too, suitable conveying means to introduce and remove the material that is being conveyed can be incorporated ahead of or after the conveyor tube.

Preferably the dipping bath is arranged beneath the front end of the tube, as viewed in the direction in which the material moves, and extends from an area that is spaced ahead of the feed opening for the small parts to part, in particular approximately one-half, of the length of the tube, the front rim edge and the side rim edges of the dipping bath forming the coating agent weir edge and the rear weir edge, as viewed in the direction of the movement, being formed by an area of the ribbon conveyor whose shortest distance, from the deepest point of the tube being equal to the overflow line. The rear rim edge of the dipping basin can form a seal on the outer wall of the tube in the area of the ribbon conveyor that forms the rearmost weir edge. The tube in this area that follows in the direction of movement can incorporate a coating agent overflow.

In this way an adequate level of coating agent is maintained within the tube and, in addition, it is possible to remove the coating agent from the tube in the area that follows the actual coating zone and then return it to the coating process once again by using the appropriate means.

It is preferred that the height of the ribbon conveyor within the area from the insertion opening for the small parts to the area that forms the rear weir edge be lower than the surface level in the tube as determined by the weir.

This, too, helps to ensure a sufficient level of the coating agent within the tube, so that even and complete coating of the small parts can be achieved.

Further, it is preferred that the tube be perforated in the area of its periphery that immediately follows the rear rim edge of the dipping basin, as viewed in the direction of movement, and preferably in the coating zone that precedes this in the direction of movement.

Perforation of the tube in the peripheral area that follows immediately after the rear rim edge of the dipping basin as viewed in the direction of movement ensures that the coating agent can run off and drip away at that point, so that at the removal end of the tube the small parts that have been coated can be removed without any excess coating agent remaining on them. Perforation of the tube in this area is both beneficial and advantageous in order to promote access to the coating agent.

It is also preferred that for a catch basin to be arranged beneath the dipping basin and beneath the perforated area of the tube.

Excess coating agent that drips out from the perforation zone that follows the coating zone can be caught by this catch basin, as can coating agent that runs over the front and side weir edges of the dipping basin.

The apparatus can include a coating agent feed pump, the input to which is connected to the catch basin, and the output of which leads into the dipping basin or, preferably, to a spray system that is installed in the front opening of the tube and directed into the coating zone.

It is preferred that the catch basin be of a shape that results in the coating agent collecting at a low point, at which the coating agent can also be drawn off by means of the coating agent feed pump. The coating agent can be moved back into the coating zone or into the dipping tank by the pump, so that it can be reused for the coating process.

Advantageously the tube is composed of plastic or another material that is not electrically conductive, button-like electrical contacts passing through this in the area that is located from the opening to the end of the coating zone. Mushroom heads of these contacts can protrude from the inside wall of the tube, and on the outside of the tube can be connected to each other in the peripheral direction and/or in the axial direction by contact rails that are electrically insulated to the outside. These contact rails can lead to rotating power rails that are secured to the outside of the tube, close to the end, and in their turn these are connected through slip-type or rolling contacts to one pole of the power source.

Such an arrangement results in an extremely functional apparatus; the mushroom heads of the contact pins, which protrude from the contact pins, which protrude from the wall of the tube, are continuously cleaned by the small parts that are introduced continuously so as to be coated, and this ensures good contact between these contact pins and the small parts.

Preferably the apparatus is mounted in a frame that incorporates support rollers for the tube and a drive motor for the tube, the drive motor being coupled to a driver pinion that engages in a toothed driver ring that is secured to the outside of the tube.

Finally, it is preferred that the other pole of the power source be connected to a contact plate that forms the second electrode, this plate being arranged beneath the tube, in the dipping basin.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
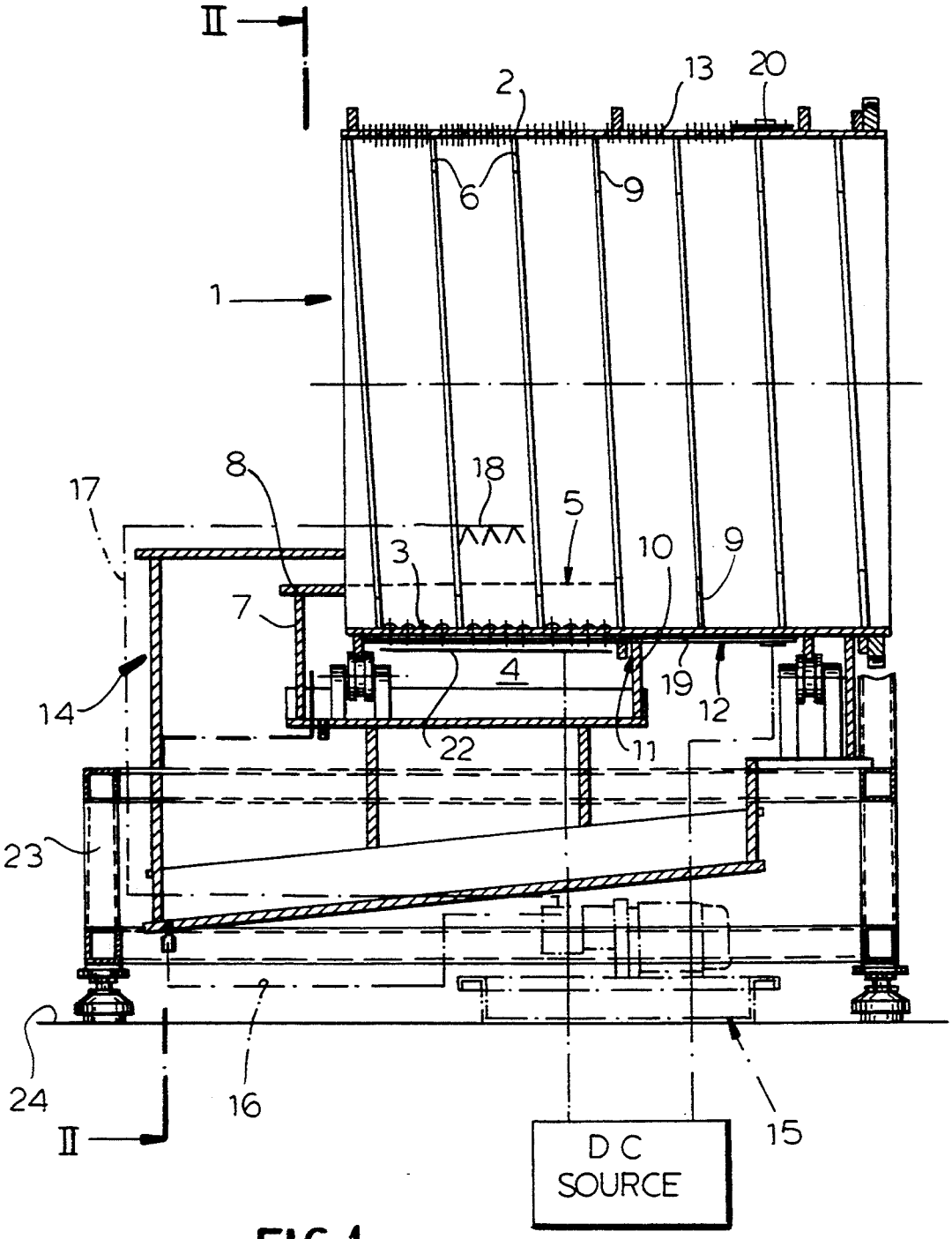
FIG.1 is a midline cross sectional view of an embodiment of the present invention taken along line I—I of FIG. 2.

The apparatus that is used for the electrolytic coating (electrophoretic enamelling) of small parts that are electrically conductive, in particular metal parts, consists of a screw conveyor 1. The conveyor 1 has electrically conductive contacts 3 on the inside of its conveyor tube 2 and these contacts are connected to one pole of a DC power source (not shown herein).

One part of the cross section of the screw conveyor 1 is immersed in a dipping basin 4, which is connected to the other pole of the power source. The level 5 of the electrolyte in the dipping basin 4 intersects the cross section of the tube 2 as a secant, in the lower area thereof. In the embodiment that is shown, the screw conveyor comprises a rotating conveyor tube 2 that supports the small parts, and ribbon conveyor 6 that is attached to the inside periphery acts as the thrust organ. The open ends of the conveyor tube 2 form the insertion opening (on the left-hand side of the drawing) and the removal opening (on the right-hand side of the drawing) for the small parts.

Figure 2:
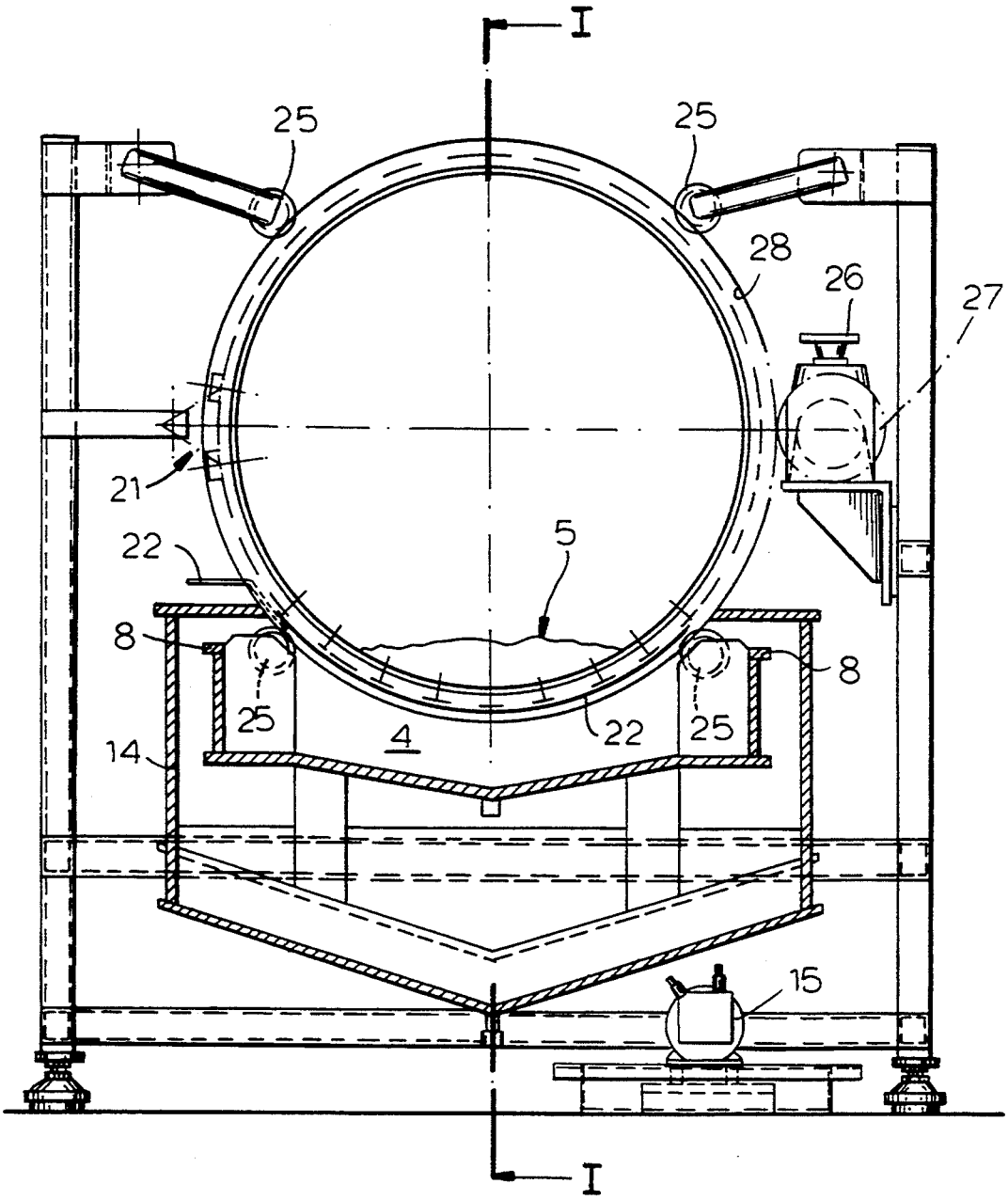
FIG. 2 is a cross section on the line II—II in FIG. 1.

The dipping basin 4 is arranged beneath the front end of the tube 2 (as viewed in the direction of movement of the parts) and extends from an area that is spaced slightly in front of the insertion opening for the small parts to approximately one-half the length of the tube 2. The front rim edge 7 and the side rim edges 8 of the dipping basin form a weir edge for the coating agent. The rear weir edge, as viewed in the direction of movement, is formed by an area of the ribbon conveyor, the point of which that is furthest from the deepest part of the tube (as the bottom of FIGS. 1 and 2) can be at the same level as the overflow line of the weir edge, although it is preferred, as shown in the exemplary embodiment, that it extend beyond this overflow line that is indicated by the fill-level line at 5. The rear rim edge 10, as viewed in the direction of movement, of the dipping basin 4 lies so as to form a seal (at area 11) on the outer wall of the tube 2, in that area of the screw conveyor (9) that forms the rearmost weir edge. The tube 2 incorporates a coating agent overflow 12 in the area that follows this area in the direction of movement.

The height of the ribbon conveyor 6 in the area ahead of the small part insertion opening (on the left-hand side in FIG. 1) as far as the area (9) that forms the rearmost weir edge is lower than the surface level 5 in the tube that is determined by the weir. The tube 2 is perforated in its peripheral area that follows immediately after the rear edge 10 of the dipping basin (as viewed in the direction of movement), and, preferably in the coating zone that is immediately ahead of this as viewed in the direction of movement. These perforated areas are indicated at 13 in the drawings.

Beneath the dipping basin 4 and beneath the perforated area 13 of the tube 2 there is a catch basin 14.

The coating agent that runs over the weir edge 7, 8, and the coating agent that runs off behind the rear rim edge 10 can be caught by the catch basin 4 and returned to the coating process. To this end, the apparatus incorporates a coating agent feed pump 15; the inlet for this pump is connected through a line 16 to a drain opening at the deepest point of the catch basin 14, and the outlet of the pump is connected through a connector line 17 to a spray system 18 that is installed in the front opening of the tube 2 and directed into the coating zone of the tube 2.

It is preferred that the tube 2 be of plastic. In the area that is located from the opening as far as the end of the coating zone, button-like contact pins 3 pass through the tube 2. Inside the tube, these contacts project from the wall of the tube; on the outside of the tube they are connected to each other in the peripheral direction and/or in the axial direction by contact rails 19 that are electrically insulated on the outside.

The contact rails 19 are led to a rotating power rail 20 that is secured to the outer surface of the tube, in the vicinity of its end, and this in its turn is connected through slip contacts or rolling contacts 21 to one pole of the power source. This pole can form the cathode, for example, so that the contact pins 3 are of the same potential. The other pole of the power source is connected to a contact plate 22 that forms the second electrode (in the example shown, the anode), which is arranged beneath the tube 2 in the dipping basin 4 and which thus brings the coating agent to the same potential.

Because of the fact that the perforations are formed in the area of the overall coating zone, there is a good circulation of the coating agent. As the contact plate 22 is arranged beneath the perforations 13 in the coating zone, there is an even flow to the parts that are to be coated, and a shorter path for the flow from the contact plate 22 through the perforations 13 to the work pieces that are to be coated is formed; this is advantageous from the standpoint of the power that has to be used. This arrangement results in an even coating of the work pieces for a lower power consumption. The apparatus is mounted in a frame 23 and secured to the base 24. The frame comprises support rollers 25 for the tube 2 and a drive motor 26 to rotate the tube 2, the drive motor 26 being coupled to a driver pinion 27 that engages in a toothed driver ring 28 that is secured to the tube 2. In order to carry out electrolytic coating, the dipping basin 4 is first filled so that the surface level 5 is reached. Subsequently, the tube 2 can be charged with small parts through the filler opening. These small parts are then moved through the tube 2 by the ribbon conveyor 6. When this takes place, they must of necessity move through a zone that contains the coating agent; when this happens, they come into contact with the contacts 3 and are brought to the appropriate electrical potential, whereas the coating agent is at the opposite potential. Coating is effected at relatively high voltage and low current, for example, 50 Amperes and 220–250 volts.

The coating process lasts for approximately four seconds. The coated small parts then pass through that part of the tube 2 that follows the higher ribbon height, and in which excess coating agent can run off through the perforations 13 in the tube 2 and collect in the catch basin 14. The small parts can then be removed at the removal opening of the tube 2 and be moved, for example, onto the next conveyor system.

The apparatus according to the present invention is extremely compact and very functional, and this permits a high throughput of parts that are to be coated, with very brief dwell times and using only a small number of operating personnel.

The present invention is not restricted to the embodiment described herein, but can be varied within the context of the disclosure.

In order to give some indication of the size of the apparatus, it is pointed out that the diameter of the tube that is shown in this embodiment is 1 meter.

We claim:

1. An apparatus for electrolytically coating electrically conductive small parts, comprising:

a conveyor tube rotatable about a generally horizontal axis, having an inlet opening at one axial end of said tube for receiving electrically conductive small parts to be coated, and an outlet opening at an opposite axial end of said tube for discharging coated parts;

screw conveyor means along an interior of said tube for advancing said small parts from said inlet to said outlet as said parts are coated;

a dipping basin for containing a bath of electrically conductive liquid coating agent at said one axial end of said tube and extending from a location ahead said tube to a location part way along the length of said tube from said inlet end to said outlet end with said tube and said screw conveyor means at a lower portion adapted for immersing in the liquid coating agent of said basin, said basin having a front rim and side rims forming overflow weirs for establishing a level of said liquid coating agent in said tube, a rear wall of said basin sealing against an outer surface of said tube whereby said tube is formed with an overflow for said liquid coating agent;

means below said basin and said overflow for collecting said liquid coating agent;

electrical contacts formed on said interior of said tube for making electrical connection with said parts; and means for connecting respective terminals of a direct current electrical power source to said contacts and to the liquid coating agent in said basin whereby said parts are coated in said liquid coating agent in said tube.

2. The apparatus defined in claim 1 wherein said screw conveyor means includes a helical ribbon conveyor.

3. The apparatus defined in claim 1 wherein at least the part of said tube along which said basin extends is perforated.

4. The apparatus defined in claim 1 wherein said part of said tube along which said basin extends is substantially one half of a length of said tube.

5. The apparatus defined in claim 1 wherein said tube is perforated immediately behind said rear wall in a direction of movement of said parts through said tube.

6. The apparatus defined in claim 5 wherein said collecting means is a catch basin located beneath the first-mentioned basin and a perforated zone of said tube behind said rear wall.

7. The apparatus defined in claim 6, further comprising a coating agent feed pump having an inlet connected to the catch basin and an outlet connected to a spray system installed in the inlet opening of the tube and directed into a coating zone there within.

8. The apparatus defined in claim 7 wherein the tube is composed of plastic or another material that is not electrically conductive, the contacts are electrical contact pins passing through the tube in an area extending from the inlet opening to the end of the coating zone, said contacts protruding from an inside wall of the tube and being connected on the outside of the tube to each other in the peripheral direction and/or in the axial direction by contact rails that are electrically insulated to the outside, these contact rails leading to a rotating power rail that is secured to the outside of the tube, close to an end that is connected through slip-type or rolling contacts to one terminal of the power source.

9. The apparatus defined in claim 8 wherein the apparatus is mounted in a frame and secured to a base that comprises support rollers for the tube and a drive motor to rotate the tube, the drive motor being coupled to a driver pinion that engages in a toothed driver ring that is secured to the tube.

10. The apparatus defined in claim 9 wherein a terminal of the power source is connected to a contact plate arranged beneath the tube in the dipping basin.

* * * * *